United States Patent [19]

Robbins et al.

[11] 4,009,909

[45] Mar. 1, 1977

[54] UPWARD TUNNELING

[75] Inventors: Richard J. Robbins, Seattle; Hans A. Adami, Vashon, both of Wash.

[73] Assignee: The Robbins Company, Seattle, Wash.

[22] Filed: Jan. 10, 1975

[21] Appl. No.: 540,009

[52] U.S. Cl. ..... 299/56; 173/36; 175/94; 175/101; 175/325

[51] Int. Cl.[2] ..... E21D 9/02

[58] Field of Search ..... 299/56, 58, 31; 175/94, 175/101, 103, 171, 106, 320, 325; 64/3

[56] References Cited

UNITED STATES PATENTS

| | | | |
|---|---|---|---|
| 2,558,068 | 3/1952 | Williams et al. | 175/171 X |
| 2,633,334 | 3/1953 | Lavender | 175/171 |
| 2,647,726 | 8/1953 | Kirk | 175/171 |
| 3,123,161 | 3/1964 | Weber | 175/106 |
| 3,354,969 | 11/1967 | Ebeling | 175/94 |
| 3,604,754 | 9/1971 | Emden et al. | 175/94 |
| 3,695,718 | 10/1972 | Lauder | 175/94 X |
| 3,840,272 | 10/1974 | Crane et al. | 299/33 X |

FOREIGN PATENTS OR APPLICATIONS

| | | | |
|---|---|---|---|
| 289,522 | 1/1916 | Germany | 175/103 |

*Primary Examiner*—Ernest R. Purser
*Assistant Examiner*—William F. Pate, III
*Attorney, Agent, or Firm*—Graybeal, Barnard & Uhlir

[57] ABSTRACT

A boring assembly is advanced upwardly by thrust rams acting on a column guided traveling cross frame connected to the power tunneler from below by a non-rotating sectional support column. The support column is anchored to a holding table situated underground above the thrust ram while sections are being added to or removed from it. The boring assembly is driven by either a hydraulic motor housed in the cross frame, via a sectional drill stem housed within the support column, or by a hydraulic motor housed directly within the boring assembly.

21 Claims, 7 Drawing Figures

UPWARD TUNNELING

BACKGROUND OF THE INVENTION

1. Field of the Invention

This invention relates to a mechanism for mechanically excavating a tunnel or a blind hole upwardly from an underground location.

2. Description of the Prior Art

It is old to mechanically bore a relatively large diameter blind hole or a tunnel upwardly through an earth formation from an underground location. Rotary drilling machines for doing this are disclosed by Stoces, Bohuslav, D.Sc., Introduction to Mining, Vol. II, page 191, London: Lange, Maxwell & Springer Ltd.; and by U.S. Pat. Nos. 2,979,320 and 3,114,425. A disadvantage of these machines is that they all utilize a rotating drill stem which by necessity includes stabilizer sections of substantial size. To add a stabilizer section it is necessary to disassemble the mechanism used for collecting rock chips in order to make room for the stabilizer section. During these periods the workmen handling the drill stem sections are exposed to the hazards of an open raise. Also, the stabilizers drag against the bore wall as they rotate, increasing the torque requirements of the rotary drive mechanism. Further, it is never possible to bore a perfectly straight hole. The drill stem is always slightly curved despite the presence of stabilizers. As a result, the drill stem wobbles during rotation and the drill stem material is alternately subjected to tension and compression forces severely fatiguing such materials. Also, in such machines the mechanism for rotating the drill pipe must be advanced and retracted axially of tunnel. The apparatus required for doing this adds size to the underground machine.

Another type of machine for boring upwardly from an underground location is shown by U.S. Pat. No. 2,864,600. Such machine is supported by "gripper" mechanisms which make tight engagement with the tunnel wall rather than by drill pipe. A disadvantage of this type of system is that the gripper mechanisms require ideal ground conditions to be dependable and ideal ground conditions are not always present. U.S. Pat. No. 3,354,969 discloses a similar machine which includes an in hole power tunneler which is driven forwardly by powered drive wheels. This type of machine also requires ideal ground conditions.

U.S. Pat. No. 3,604,754 discloses an overhead boring machine of a type which utilizes both a gripper mechanism for engaging the bore wall and a sectional support column which is erected in the hole below the boring machine. In the system of this patent, the mined material or cuttings are delivered into the hollow interior of the support column. As a result, the machine at the underground site is quite complex because it requires a means for handling the column sections and advancing the column upwardly which must be constructed and positioned to not interfere with the discharge of the mined material out from the support pipe.

U.S. Pat. No. 3,840,272 discloses an overhead tunneling apparatus comprising a power tunneler which is supported from below by a non-rotating sectional support column. The sectional support column comprises a tubular center portion and a plurality of radially extending stabilizer fins which brace the support column against bending. The tunneler delivers the mined material into the space between a pair of such stabilizer fins through which space the material falls to a hopper mechanism below. The tunneler and the support column are advanced upwardly by a central thrust ram which also doubles as a support column loader. The support column is moved upwardly through a sealed opening in the bottom of the hopper and the column sections are added to and removed from the column in the space below such hopper.

U.S. Pat. No. 3,840,272 is owned by the assignee of this invention.

SUMMARY OF THE INVENTION

The overhead boring apparatus of the present invention comprises a non-rotating support column which is connected at its lower end to a traveling cross frame which is supported for precision movement by a plurality of guide columns. The cross frame is advanced and retracted by one or more thrust cylinders interconnected between it and a fixed frame portion of the machine. Owing to this arrangement the machine is vertically shorter than the machine disclosed by the aforementioned U.S. Pat. No. 3,840,272. The torque is transferred from the support column to the cross frame by a slip-joint connection between the two.

According to an aspect of the invention the boring assembly is rotated by either a motor housed in the cross frame, via s sectional drill stem within the support column, or by a motor housed directly within the frame of the boring assembly.

Additional features and advantages of the overhead tunneling equipment of this invention will be apparent from the following description of two illustrated embodiments.

DESCRIPTION OF THE PREFERRED EMBODIMENT

Figure 1:
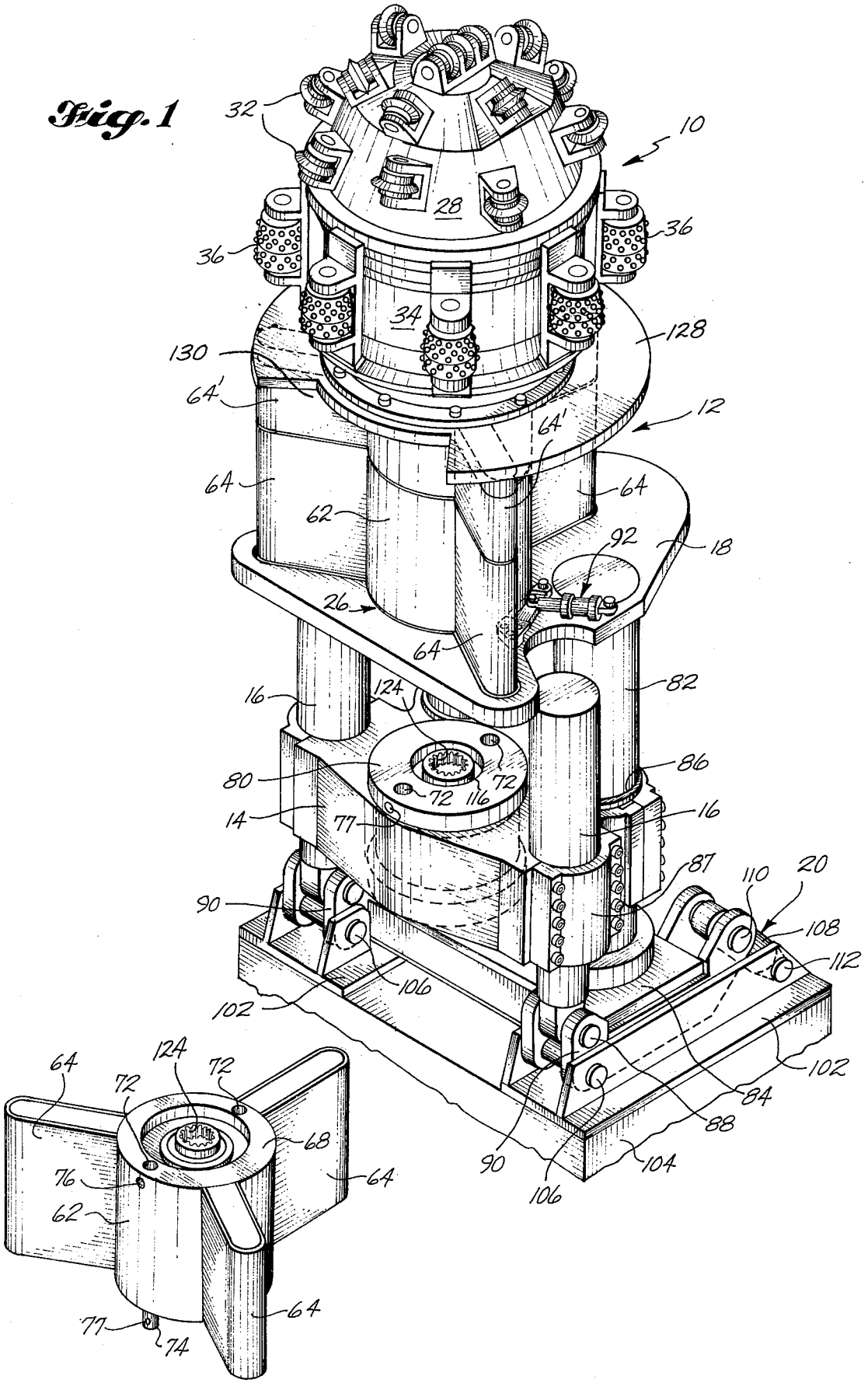
FIG. 1 is an isometric view of an embodiment of the invention, showing the boring assembly and a first section of the support column locked in position relative to the work table, showing the traveling frame in the process of being lowered to accept a second section of the support column, and showing a second section of the support column in spaced relationship thereto.

The illustrated embodiment comprises a boring or cutterhead assembly 10; a sectional support column 12; advancing mechanism including a traveling cross frame 14 and thrust cylinders 16, for forcing the sectional support column 12 upwardly to in that manner forceably advance the cutterhead assembly 10 into the overhead ground formation; a holding table 18 at the underground location above the cross frame 14; and the necessary frame and support structure, including a base assembly 20.

The cutterhead assembly 10 includes a non-rotating tubular frame 22 having a hollow interior and a tail section 24. As hereinafter will be described in greater detail, the tail section 24 has an external cross-section configuration which matches the external cross-configuration of the support column sections 26. Also, tail section 24 is connectable to the uppermost section 26 of the support column 12 in the same manner that adjacent sections 26 are connected together.

A drum-like cutterhead or boring head 28 is mounted for rotation relative to frame 22 by means of a plurality of roller bearings 30. Boring head 28 includes an upper portion which carries a plurality of roller-type cutters, some of which are designated 32. In the preferred embodiment these cutters 32 are in the nature of disc cutters. The boring head 28 also includes an outer cylindrical wall portion 34 which carries a plurality of roller cutters 36 of the carbide button type. Cutters 36 are arranged to engage the side wall of the tunnel or raise. The disc cutters 32 cut a plurality of concentric kerfs in the hard ground formation and fracture the material between the kerfs. The roller cutters 36 help establish the gage of the tunnel or raise, and also stabilize the cutterhead assembly 10 to prevent undesirable wobbling or other lateral movement. In some embodiments it may be desirable to replace the carbide button rollers with smooth surface rollers which function as stabilizers but not gage cutters.

During cutting the cutters 32 are directed upwardly and the tail section 24 is directed downwardly. Cutterhead assembly 10 includes a power input shaft 38 which is also directed downwardly during boring. Shaft 38 drives a first sun gear 40 which is part of a first stage planetary gear assembly housed within tubular frame 22. Sun gear 40 meshes with a plurality of planet gears 42 which are mounted onto a carrier 44. Planet gears 42 also mesh with an internal tooth orbit gear 46. Carrier 44 is journaled for rotation relative to input shaft 38. It is directly connected to a second shaft 48 which is coaxial with shaft 38. Shaft 48 is connected to a second sun gear 50 which meshes with a plurality of planet gears 52. Planet gears 52 mesh with and travel around an internal tooth orbit gear 54. Planet gears 52 are mounted on a carrier 56 which is directly connected to the boring head 28.

Figure 2:
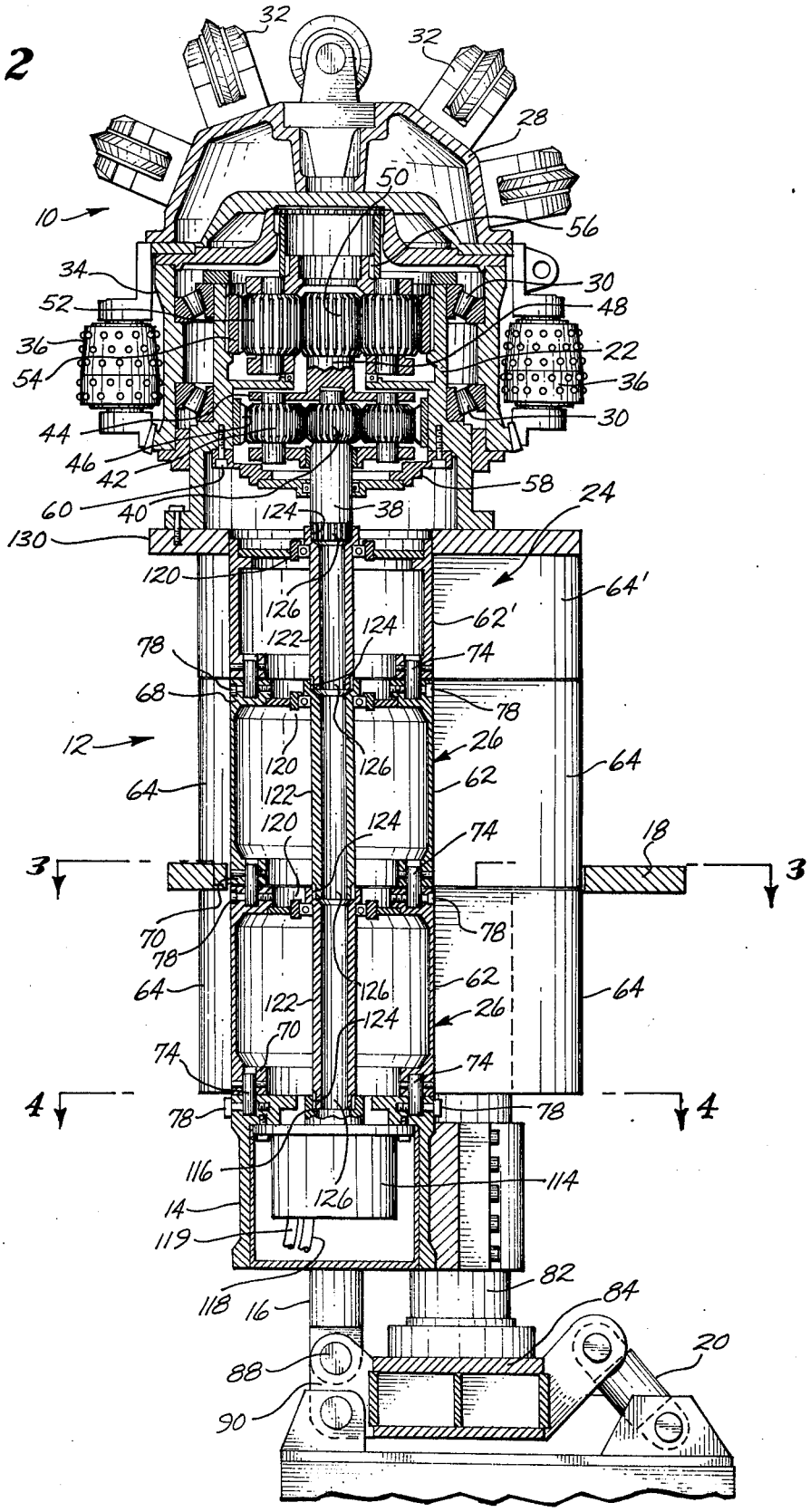
FIG. 2 is a longitudinal sectional view of the embodiment, which the second section of the support column interconnected between the first section and the drive motor.

In FIG. 2 the first stage planetary gearing is shown to be held in place by a retainer plate 58 which is held in place by a plurality of mounting bolts 60.

As best shown by FIGS. 1 and 2, the support column sections 26 each comprise a tubular body portion 62 and a plurality (e.g. three) of radial stabilizer fins 64. When a column section 26 is within the bore 66, the outer radial boundaries of the fins 64 are contiguous the bore wall. This can be seen by FIG. 5 which shows the outer edges of one set of fins 26 nearly colinearly related to the side wall of the bore 66.

In the illustrated embodiment each column section 26 comprises relatively thick and husky annular end portions 68, 70. Axial sockets 72 are provided in the end members 68 and are sized to receive axial locator pins 74 which are carried both by the tail section 24 of the cutterhead assembly 10 and by the lower end member 70 of each other support column section 26. Each end member 68 is formed to include connector pin openings 76 extending laterally through the sockets 72. Each locator pin 74 includes a complementary connector pin opening 78 which becomes aligned with connector pin openings 76 when the locator pins 74 are within the sockets 72. The pins and sockets 72, 74 serve to correctly orient the support column sections 26 relative to each other and relative to the tail section 24. They also function to transmit torque between the sections 26. Connector pins 78 are inserted through the aligned openings 76, 77 to connect adjacent column sections 26 together axially, or to connect the upper column section 26 to the tail section 24, or to connect the lower column section 26 to the cross frame 14. Cross frame 14 carries a ring member 80 which includes locator pin socket 72 and connector pin openings 77 (FIG. 1).

The holding table 18 includes an opening sized to closely surround the support column sections 26 or the tail section 24 of cutterhead assembly 10, whichever happens to be positioned within such opening. In other words, such opening includes a central circular portion which is only slightly larger in diameter than the body portion 62 of the column sections 26, and the corresponding body portion 62' of tail sections 24, and three equally spaced apart radial cut-outs which are only slightly larger in size than the stabilizer fins 64, 64'.

The frame and support structure includes at least one, but preferably at least two support columns 82 which may be connected at their upper ends to the holding table 18 and at their lower ends to a base member 84. The cross frame 14 includes bearings 86 mounting it for precision up and down movement relative to the guide columns 82. In the preferred embodiment the chamber or cylinder portions of the double acting hydraulic motors 16 are attached near their open ends to the cross frame 14, such as by clamp members 87. The rod portions of the pistons extend downwardly from piston heads housed within the chambers and at their lower ends such rods are pin connected at 88 to frame members 90. Pin members 88 are fixed in position relative to the base member 84.

The motors 16 are used for thrusting the cross frame 14 up and down along the guide columns 82, relative to the positions of the base member 84 and the mounting pins 88. During tunneling the drilling torque is transmitted from the cutterhead assembly 10 first through the support column 12, from support column 12 to the cross frame 14 (by way of the pin and socket connections 72, 74), from cross frame 14 to guide columns 82, and from guide columns 82 to the base member 84.

In at least some embodiments it may be desirable to utilize the relatively snug fit between the opening in holding table 18 and the tail section 24 and the column sections 26 for reacting some of the torque, such as in the manner disclosed in the aforementioned U.S. Pat. No. 3,840,272.

Figure 3:
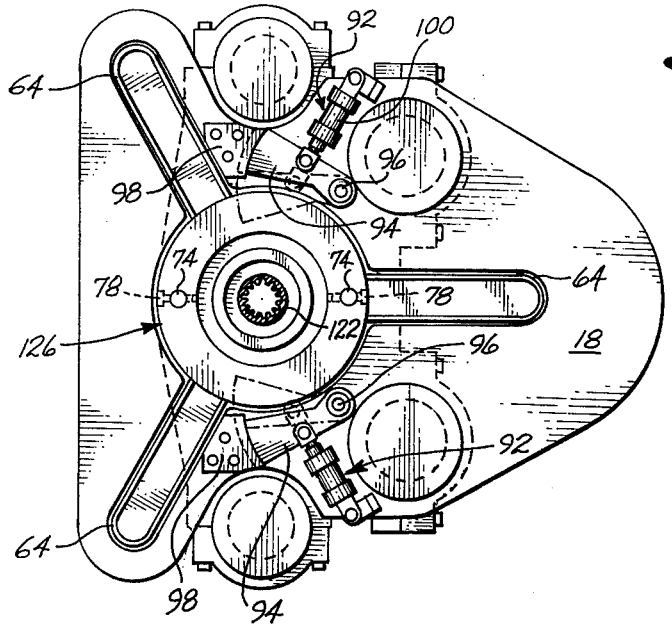
FIG. 3 is a sectional view taken substantially along line 3—3 of FIG. 2.
Figure 6:
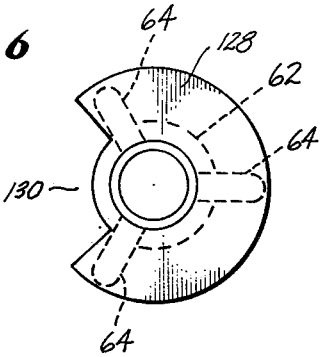
FIG. 6 is a sectional view taken substantially along line 6—6 of FIG. 5.
Figure 4:
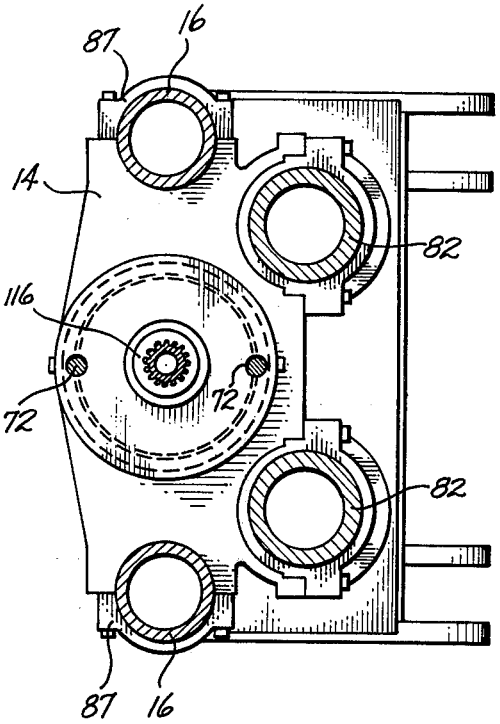
FIG. 4 is a sectional view taken substantially along line 4—4 of FIG. 2.

Preferably, a pair of generally diametrically opposed latching mechanisms 92 are mounted onto the holding table 18, to serve as means for temporarily securing the support column 12 to the holding table 18 during addition or removal of column sections 26 therefrom. Latching mechanisms 92 may comprise a locking arm 94 mounted by a pivot pin 96 at one end thereof for pivotal movement relatively in towards and relatively out from the support column sections 26; a guide 98 for the moving end of member 94, and a double acting actuator 100 of a suitable type (e.g. a double acting linear hydraulic motor). In such embodiment the body portions 62, 62' of the support column sections 26 and the tail section 24 are provided with transverse recesses sized to snugly receive the lock members 94. FIG. 3 includes a solid line showing of the members 94 withdrawn from engagement with the recesses and also a broken line showing of such members 94 positioned within such recesses. In other embodiments this type of lock mechanism can be replaced by something that is functionally equivalent, e.g. a cross pin and socket system such as disclosed by the aforementioned U.S. Pat. No. 3,840,272.

Figure 5:
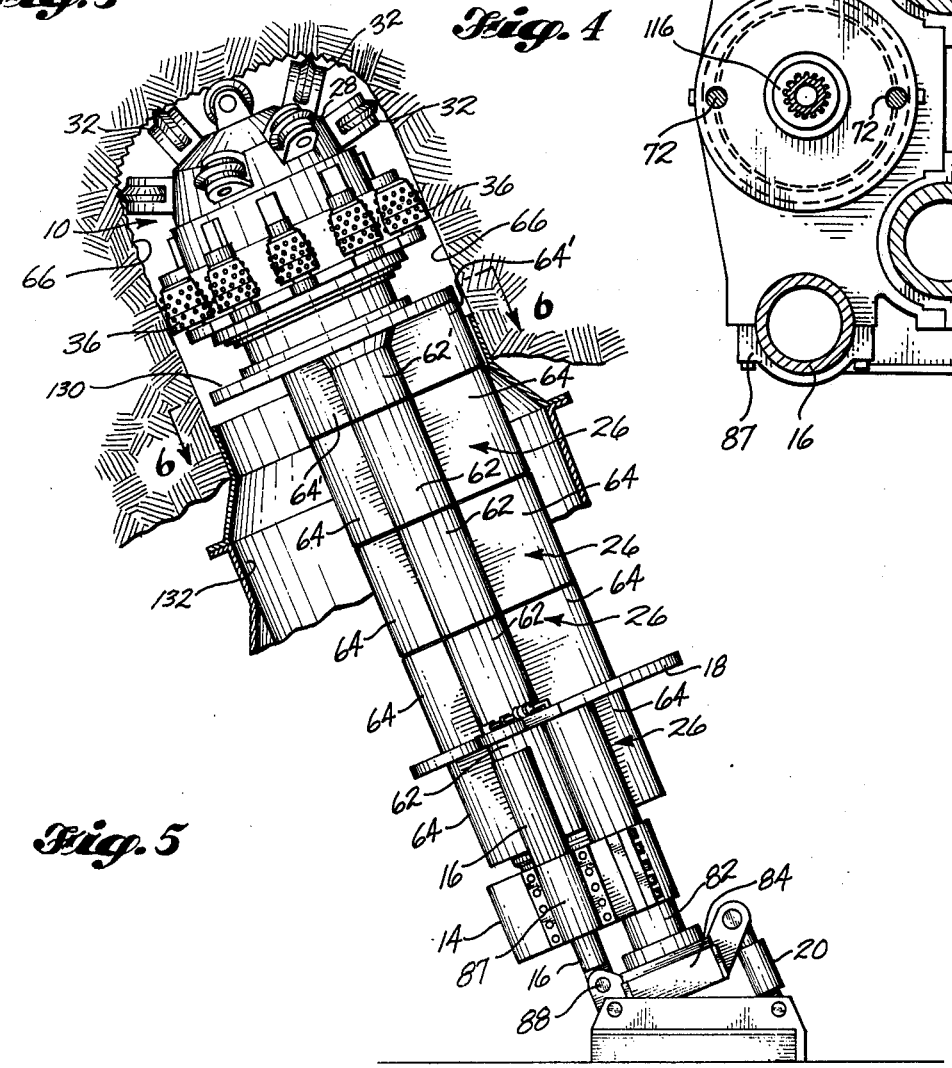
FIG. 5 is a side elevational view of the embodiment in the process of boring a slanted hole.

The embodiment of FIGS. 1 – 6 is shown to comprise a pair of spaced apart metal shoes 102 which are secured to the ground or a foundation 104 at the underground site for the machine. Mounting feet 102 each includes a pair of spaced apart upstanding portions between which the frame members 90 are received. Pivot pins 106 serve to pivotally connect the frame members 90 to such upstanding portions. Turnbuckles 108 are provided at the opposite ends of mounting feet 102. the turnbuckles 108 are pin mounted at their ends 110, 112 to the frame members 90 and the mounting feet 102. The turnbuckles 108 are adjusted in length for the purpose of changing the angular position of frame members 90 and the machine components thereabove relative to the mounting feet 102 and the foundation or ground structure 104. FIG. 2 shows the turnbuckles 108 adjusted to position the boring axis generally upright. FIG. 5 shows such turnbuckles 108 adjusted outwardly so as to rotate the boring axis from vertical over into a leaning position.

In the embodiment of FIG. 1 – 6 the hydraulic drive motor 114 is housed within a recessed portion of the cross frame 14. Motor 114 includes an upwardly directed output shaft 116. A manifold structure including supply and return lines 118, 119 are located within cross frame member 14, within a cavity generally below the motor 114.

The tail section 24 of cutterhead assembly 10 and each support column section 26 includes internal journal structure 120 which rotatably mounts a rotary drive shaft section 122. In the illustrated embodiment each drive shaft section 122 includes a splined socket 124 at its upper end and a splined pin 126 at its lower end. Input shaft 38 includes a splined pin received within the splined socket 124 of the drive shaft section 122 which is carried by tail section 24. Output shaft 116 of drive motor 114 includes a splined socket for receiving the spline pin at the lower end of the lowermost support column section 26.

As clearly shown by FIG. 2, the splined pin-socket joints between the drive shaft sections constitute pin and socket slip joints. Axial movement of a column section 26 to either engage or disengage a set of locating pins 74 with or from a set of sockets 72 also serves to engage or disengage the splined pins 126 with or from the splined sockets 124.

The cutterhead support includes a transverse wall 128 which is located between the tail section 62' and the cutterhead support proper. Transverse wall 128 is circular (FIG. 6) and generally conforms to the fly diameter of the rotary cutterhead means. A passageway, in the form of a cut-out 130, is provided in wall 128 between an adjacent pair of support column fins 64. As best shown by FIG. 5, during boring the ground material which is cut from the bore face falls through opening 130 and travels between the fins 64 into a hopper or collection device 132 which may be of the type shown by the aforementioned U.S. Pat. No. 3,840,272.

Figure 7:
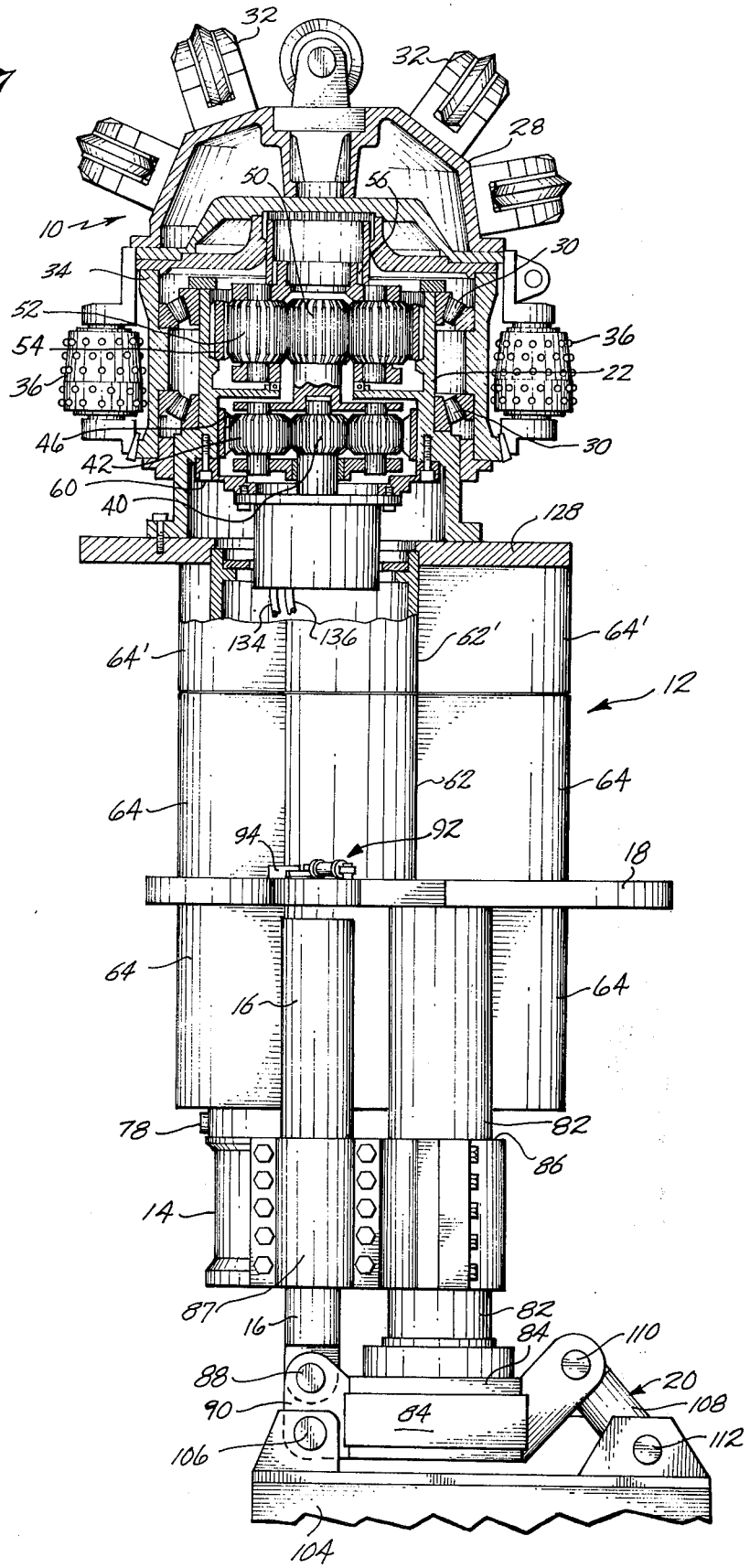
FIG. 7 is a view like FIG. 2 but of a modified embodiment.

In a second embodiment of the invention, shown by FIG. 7, the hydraulic motor 114 is mounted within the hollow interior of frame 22 and is bolted to member 58. The shaft 38 extends into a hollow centered shaft in motor 114 and its lower end splines mate with internal splines in said shaft. In such embodiment the drive shaft sections 122 are omitted from within the support column sections 26 and from tail section 24. Sectional supply and return lines 134, 136 for the motor 114 are fed upwardly with the machine through the hollow interior of one of the stabilizer fins 64, 64' in the manner disclosed by the aforementioned U.S. Pat. No. 3,840,272.

It will be apparent to those skilled in the art to which this invention pertains that various additional changes and modifications may be made to the boring machines of this invention without departing from the spirit and scope of the invention, as defined by the following claims.

What is claimed is:

1. Mechanism for boring upwardly through ground material from an underground location, comprising:

a cutterhead assembly comprising a cutterhead support including a tail section which is directed downwardly during boring and rotary cutterhead means rotatably mounted onto said cutterhead support, said rotary cutterhead means including cutter means which is directed upwardly during boring and a rotary input shaft which is directed downwardly during boring; and means for advancing said cutterhead assembly and rotating said rotary cutterhead means, comprising:

a sectional support column positionable below said cutterhead assembly, and connectable to said tail section;

thrust ram means positionable at the underground location for forcing said sectional support column upwardly to in that manner advance the cutterhead support and the rotary cutterhead means carried thereby, said thrust ram means including torque transfer connector means connectable to said sectional support column, for restraining said sectional support column against rotation during advancement of the sectional support column and the cutterhead assembly carried thereby;

a holding table positionable at the underground location above said thrust ram means, said holding table including means for securing said sectional support column to said holding table while a section is being added to or removed from it;

a rotary drive means carried by and movable with said thrust ram means, including a rotary output shaft; and a separate rotary drive shaft section for each section of the support column, each of which is journaled for rotation inside of its section of the support column, each said rotary drive shaft section including joint means at its upper and lower ends, with the joint means at its upper end being detachably connectable to the input shaft of the rotary cutterhead means and the joint means at the lower end of each other rotary drive shaft section, and with the joint means at the lower end of each section being detachably connectable to the output shaft of the rotary drive means and the joint means at the upper end of each other drive shaft section.

2. Mechanism according to claim 1, wherein said thrust ram means comprises a fixed frame including at least one guide column extending in the direction of boring, a cross frame mounted for up and down movement along said guide column, and at least one thrust cylinder interconnected between said cross frame and the fixed frame, for moving the cross frame along said guide column between an elevated position in which the cross frame is closely adjacent the holding table and a lowered position in which said cross frame is spaced below the holding table a sufficient amount that a section of the sectional support column can be inserted inbetween the cross frame and the holding table, wherein said cross frame includes means to which the lower end portion of each section of the support column may be secured, for restraining such section, and in that manner all other sections of the support column and the cutterhead support above it, against rotation, said cross frame also carrying the rotary drive means.

3. Mechanism according to claim 2, wherein the rotary drive means is a rotary hydraulic motor.

4. Mechanism according to claim 1, including gear reduction means carried by said cutterhead support and drivenly connected to said rotary cutterhead means, wherein said input shaft constitutes the input shaft of said gear reduction means.

5. Mechanism acccording to claim 4, wherein said cutterhead support includes a tubular body, said gear reduction means is housed within said body, said rotary cutterhead means includes a tubular side wall portion which surrounds said tubular body and a forward portion on which the cutter elements are mounted, and combination radial and thrust bearings are interposed between said tubular body and the tubular side portion of the rotary cutterhead means, for journaling the rotary cutterhead means onto the cutterhead support.

6. Mechanism according to claim 4, wherein said input shaft includes a joint component which is a first component of a two component axial slip joint which is capable of transmitting torque and which is coupled and decoupled by an axial movement of the input shaft joint component relative to a complementary second joint component on a drive shaft section within a section of the support column.

7. Mechanism according to claim 4, wherein the tail section includes one component of an axial pin and socket type slip joint for connecting the tail section to the sectional support column.

8. Mechanism according to claim 4, wherein the gear reduction means comprises a two stage planetary housed within the cutterhead support, including a sun gear connected to the input shaft, a plurality of planet gears surrounding said sun gear and meshing therewith, a carrier for said planet gears, a shaft projecting from said carrier in coaxial alignment with the input shaft, on the opposite side of the sun gear therefrom, a second sun gear on said carrier shaft, a second set of planet gears surrounding said second sun gear, a second carrier for the second set of planet gears, and means connecting the second carrier to the rotary cutterhead means.

9. A cutterhead assembly which during use is progressively moved upwardly from an underground location by a sectional support column which is itself moved endwise upwardly from the underground location, and is rotated by means including a sectional drive shaft inside of said sectional support column, which includes a joint component at its upper end, said assembly comprising:

a cutterhead support including a tail section which during use is directed downwardly;

a cutterhead journaled for rotation on said cutterhead support and including cutter elements thereon which are directed upwardly during use;

a joint component on said tail section usable for detachably connecting the tail section to the sectional support column; and gear reduction means carried by said cutterhead support, and drivenly connected to said cutterhead, said gear reduction means having an input shaft which during use is directed downwardly and which rotates relative to said cutterhead support, said input shaft having a joint component at its lower end connectable to the upper end of the sectional drive shaft within the sectional support column.

10. The cutterhead assembly according to claim 9, wherein said cutterhead support includes a tubular body, said gear reduction means is housed within said body, said cutterhead includes a tubular side wall portion which surrounds said tubular body and a forward portion on which the cutter elements are mounted, and combination radial and thrust bearings are interposed between said tubular body and the tubular side portion of the cutterhead, for journaling the cutterhead onto the cutterhead support.

11. The cutterhead assembly according to claim 9, wherein the joint component on said input shaft is a component of a slip joint which is capable of transmitting torque and which is coupled and decoupled by a relative axial movement between the input shaft joint component and a complementary joint component on a drive shaft section within a section of the support column.

12. A cutterhead assembly according to claim 9, wherein the joint component on said tail section is a component of a pin and socket slip joint and includes a transverse opening for receiving a lock element which is insertable through both said opening and a similar opening in the other component of the joint.

13. A cutterhead assembly according to claim 9, wherein the gear reduction means comprises a two stage planetary housed within the cutterhead support, and comprising a sun gear connected to the input shaft, a plurality of planet gears surrounding said sun gear and meshing therewith, a carrier for said planet gears, a shaft projectin from said carrier in coaxial alignment with the input shaft, on the opposite side of the sun gear therefrom, a second sun gear on said carrier shaft, a second set of planet gears surrounding said second sun gear, a second carrier for the second set of planet gears, and means connecting the second carrier to the cutterhead.

14. A cutterhead assembly according to claim 9, wherein the tail section of the cutterhead support substantially matches the support column sections in cross sectional configuration, and wherein said tail section includes a tubular central portion and a plurality of stabilizer fins which extend radially outwardly from said tubular central portion.

15. A cutterhead assembly according to claim 14, comprising a transverse wall between said tail section and the cutterhead support proper, said wall being generally circular and generally conforming to the fly diameter of the cutterhead, and an opening through said wall between a pair of adjacent fins on the tail section, to be a passageway for ground material cut by the cutterhead during use of the cutterhead.

16. A section of a sectional torque carrying support and drive column that is used for supporting and applying an upward thrust to a cutterhead assembly, and for rotating a rotary cutterhead part of said assembly, said support and drive column section, comprising:

a tubular body;

torque transferring connector means at each end of said body for use in connecting it to an end of a similar body;

a section of rotary drill pipe assembled with said tubular body and extending axially within said body and having a joint component at each of its ends for use in detachably connecting it to another drill pipe section; and journal means carried by said body, journaling said drill pipe section for rotation within said body.

17. A support and drive column section according to claim 16, including means on said tubular body against which a bracing force can be applied for bracing said body against rotation, said means being a part of the joint components at the ends of the section.

18. A support and drive column section according to claim 16, wherein the joint component at one end of the rotary drill pipe is a pin portion of a pin-box type axial slip joint which is capable of transmitting torque and the joint component at the opposite end of the section is the second component of such a slip joint.

19. A support and drive column section according to claim 18, wherein the connector means at each end of said body for use in connecting it at an end of the similar body comprises a plurality of axial pin elements at one end of the body and a plurality of complementary axial box sockets formed in the opposite end of the body, with at least one of the pins and one of the box sockets being formed to include a transverse passageway for receiving a lock pin.

20. Mechanism for boring upwardly through ground material from an underground location, comprising:

a cutterhead assembly comprising a cutterhead support including a tail section which is directed downwardly during boring, and rotary cutterhead means rotatably mounted onto said cutterhead support including cutter means which is directed upwardly during boring;

means for rotating said rotary cutterhead means; and means for advancing said cutterhead assembly, comprising:

a sectional support column positionable below said cutterhead assembly, and connectable to said tail section;

thrust ram means positionable at the underground location for forcing said sectional support column upwardly to in that manner advance the cutterhead support and the cutterhead means carried thereby, said thrust ram means including means for restraining said sectional support column against rotating during advancement of the sectional support column and the cutterhead assembly carried thereby;

a holding table positionable at the underground location above said thrust ram means, said holding table including means for securing said sectional support column to said holding table while a section is being added to or removed from it; and said thrust ram means comprising a fixed frame including at least one guide column extending in the direction of boring, a cross frame mounted for up and down movement along said guide column, and at least one thrust cylinder interconnected between said cross frame and the fixed frame, for moving the cross frame along said guide column between an elevated position in which the cross frame is closely adjacent the holding table and a lowered position in which said cross frame is spaced below the holding table a sufficient amount that a section of the sectional support column can be inserted inbetween the cross frame and the holding table, wherein said cross frame includes means to which the lower end portion of each section of the support column may be secured, for restraining such section, and in that manner all other sections of the support column and the cutterhead support above it, against rotation.

21. Mechanism according to claim 20, further comprising torque transferring axial pin and socket type slip joints between each section of the sectional support column, between the tail section of the cutterhead assembly and the upper section of the sectional support column, and between the lower section of the sectional support column, and the cross frame.

* * * * *